US010196229B2

(12) United States Patent
Smith

(10) Patent No.: US 10,196,229 B2
(45) Date of Patent: Feb. 5, 2019

(54) FIELD AND BARBED WIRE UNROLLER APPARATUS

(71) Applicant: Charles Smith, Pine Knot, KY (US)

(72) Inventor: Charles Smith, Pine Knot, KY (US)

( * ) Notice: Subject to any disclaimer, the term of this patent is extended or adjusted under 35 U.S.C. 154(b) by 926 days.

(21) Appl. No.: 14/558,803

(22) Filed: Dec. 3, 2014

(65) Prior Publication Data

US 2016/0159606 A1 Jun. 9, 2016

(51) Int. Cl.
*B65H 49/32* (2006.01)

(52) U.S. Cl.
CPC ..... *B65H 49/32* (2013.01); *B65H 2701/363* (2013.01)

(58) Field of Classification Search
CPC ... B65H 49/00; B65H 49/32; B65H 2701/363
USPC ..... 242/557
See application file for complete search history.

(56) References Cited

U.S. PATENT DOCUMENTS 5,476,234 A 12/1995 St. Pierre
5,582,216 A 12/1996 Smith et al.
5,632,470 A * 5/1997 Leland ..... E04H 17/266 242/557
6,360,984 B1 3/2002 England
6,951,316 B1 * 10/2005 Heidelberger ..... B65H 49/32 242/403
7,011,269 B1 * 3/2006 Chouinard ..... B65H 49/32 242/403
7,195,193 B2 * 3/2007 Capps ..... E04H 17/266 242/396.5
7,264,195 B2 9/2007 Fletcher et al.
7,530,522 B2 5/2009 Popp
7,530,523 B1 5/2009 Murray
7,614,581 B2 11/2009 Beem et al.
2004/0065767 A1 * 4/2004 Parker ..... A01K 3/00 242/557
2004/0065768 A1 4/2004 Parker
2004/0144965 A1 * 7/2004 Albritton ..... B65H 49/32 256/40
2008/0258003 A1 * 10/2008 Foster ..... B65H 49/32 242/611
2009/0014578 A1 * 1/2009 Beem ..... E04H 17/266 242/557
2011/0121124 A1 * 5/2011 Wohlgemuth ..... A01K 3/005 242/403
2011/0121125 A1 * 5/2011 Stow ..... B66D 1/36 242/557

* cited by examiner

*Primary Examiner* — William A. Rivera
(74) *Attorney, Agent, or Firm* — Luedeka Neely Group, PC

(57) ABSTRACT

A wire unroller apparatus having a base configured to be removably mounted to a vehicle and at least one first spindle and a second spindle mounted to the base and configured to receive one or more spools of wire. The base has a base surface, left and right arms extending away from the base surface and terminating at ends, and a cross bar removably connected to the ends of the left and right arms. The first spindle is oriented in a first direction and is connected between the base surface and the cross bar. The second spindle is oriented in a second direction and is mounted between the left and right arms. The spools of wire on the first spindle and the second spindle may be unrolled at the same time.

19 Claims, 8 Drawing Sheets

FIELD AND BARBED WIRE UNROLLER APPARATUS

FIELD

The present disclosure relates to the apparatus for unrolling and installing rolled field wire and barbed wire, and for rolling and uninstalling the wire. More particularly, the present disclosure relates to an apparatus configured to mount to a vehicle in a variety of ways and to hold multiple spools of one or more varieties of wire, and to unroll each of the spools of wire simultaneously as the vehicle travels.

BACKGROUND & SUMMARY

Field wire and barbed wire are often used to provide an enclosure for animals and livestock. To install fencing or barbed wire, which are typically provided on spools, are typically unrolled from the spools, pulled tight and then mounted to wood or metal posts that surround the area to be enclosed. This process was often carried out by hand and required the spools to be lifted and unrolled and then for the wire and fencing to be pulled tight and then mounted to the post. This process is time consuming and labor intensive because it often required two or more workers. The task was made more difficult due to the weight of the fencing and wire as well as the barbs. In the description that follows, unless specifically noted otherwise, the term "wire" will refer generally to all varieties of spooled wire or fencing, including field wire or fencing as well as barbed wire and chain link fencing, and the like.

As a result, various devices have been created that enable the spools of field wire and barbed wire to be unspooled. Certain of these devices were mounted to hand-drawn carts and other devices were mountable to vehicles (such as a tractor), which enable the wire to be unspooled as the vehicle moves. However, these devices allow for unspooling only one type of wire at a time and not the simultaneous unspooling of multiple types of wire. Additionally, these devices are often bulky and require a significant amount of storage space.

What is needed, therefore, is an apparatus that can be mounted to a vehicle and that is configured to hold multiple spools of one or more types of wire and to enable those spools of wire to be unspooled simultaneously.

The above and other needs are met by a wire unroller apparatus having a base that is configured to hold a first and a second spindle of wire. The base of the apparatus includes a base surface, left and right arms extending away from the base surface and that terminate at ends, and a cross bar that is removably connected to the ends of the left and right arms. Sometimes the first arm and the second arm each include a first arm section extending away from the base surface and a second arm section rotatably mounted to the first arm section and terminating at an end.

A first spindle that is designed to receive one or more spools of wire is oriented in a first direction and has a first end removably connected to the base surface and a second end removably connected to the cross bar. Sometimes the first end of each of the first spindles includes an elongate extension portion configured for insertion through an opening disposed in the base surface. The extension portion has an opening configured to receive a pin to removably fix the extension portion in the opening in the base surface. Also, the second end of each of the first spindles may include an elongate extension portion configured for insertion through an opening disposed in the crossbar. The extension portion may have an opening configured to receive a pin to removably fix the extension portion in the opening in the crossbar.

A second spindle is oriented in a second direction and is configured to receive one or more spools of wire. The second spindle is removably connected to the left and right arms. The second spindle is designed so that one or more spools of wire may be located between the left and right arms. The apparatus is configured so that spools of wire on the first spindle and the second spindle may be unrolled at the same time.

The base is configured to be removably mounted to a vehicle. For example, sometimes the device includes a receiver hitch mount having a base mount configured to removably mount to the base and a vehicle mount configured to be mounted to a receiver hitch of a vehicle. In other embodiments, the apparatus includes a plurality of linkage pins configured for attachment to a 3-point hitch.

In certain embodiments, the apparatus includes a guard having ends connected to the left and right arms near the location of the second spindle. The guard extends away from the left and right arms and is configured to contact a portion of a vehicle used to lift the apparatus. The guard prevents the vehicle from contacting the one or more spools of wire located on the second spindle. For example, the apparatus may sometimes include two or more forklift receivers mounted to a bottom surface of the base that are configured to receive forks of a forklift that may be used to lift the apparatus. Additionally, the apparatus may include one or more strap connection points that are configured to receive one or more straps for removably securing a portion of the unroller apparatus to a portion of the vehicle.

Sometimes the apparatus includes cradles that are located on the left and right arm and that are configured to receive the second spindle and to hold it in place. The second spindle may sometimes include a pair of centering members that are designed for placement on either side of at least one of the cradles to prevent side-to-side movement of the second spindle when placed into the cradles. Additionally, the spindles may include at least one spool separator. The spool separators are configured for placement onto at least one of the first or second spindles adjacent the one or more spools of wire.

In a second major embodiment, the wire unroller apparatus includes a base. The base includes a base surface and left and right arms extending away from the base surface. The arms terminate at ends and a cross bar is removably connected to the ends of the arms. Sometimes the left and right arms each include a first arm section extending away from the base surface and a second arm section that is rotatably mounted to the first arm section and that terminates at an end.

The plurality of first spindles are each configured to receive one or more spools of wire and are disposed in a first direction. Preferably, at least one spool separator is placed onto the first spindles adjacent the one or more spools. The first spools have a first end that is removably connected to the base surface and a second end that is removably connected to the cross bar. Preferably, the one or more spools of wire on the plurality of first spindles may be unrolled at the same time.

The base is configured to be removably mounted to a vehicle. Sometimes the apparatus includes two or more forklift receivers mounted to a bottom surface of the base. The two or more forklift receivers are configured to receive forks of a forklift that may be used to raise and lower the base. The apparatus may also include one or more strap connection points that are configured to receive one or more straps for removably securing a portion of the unroller apparatus to a portion of the vehicle. In other embodiments, the apparatus includes a receiver hitch mount having a base mount configured to removably mount to the base and a vehicle mount configured to be mounted to a receiver hitch of a vehicle. In yet other embodiments, the apparatus includes a plurality of linkage pins configured for attachment to a 3-point hitch.

BRIEF DESCRIPTION OF THE DRAWINGS

Further advantages of the disclosure are apparent by reference to the detailed description when considered in conjunction with the figures, which are not to scale so as to more clearly show the details, wherein the reference numbers indicate like elements throughout the several views, and wherein.

DETAILED DESCRIPTION

Figure 1:
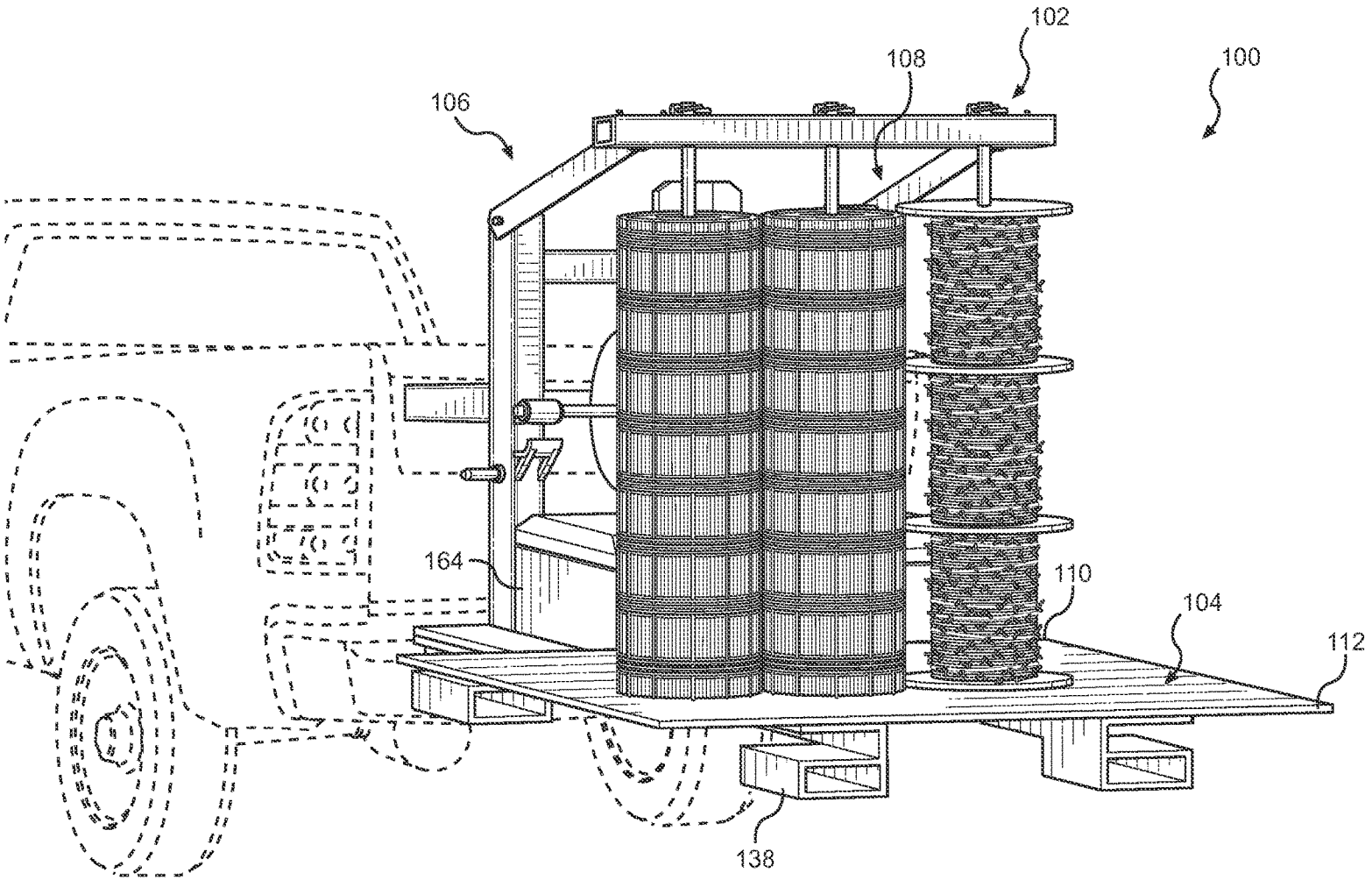
FIG. 1 is a perspective view of a wire unroller apparatus mounted to a receiver hitch of a vehicle and having three vertical spools loaded with a variety of wire according to embodiments of the present invention.

Embodiments of a wire unroller apparatus of the present invention are disclosed in the following detailed description and figures. The unroller apparatus assists a user in loading, rolling, and unrolling one or more spools or wire quickly and easily. With initial reference to FIGS. 1 and 2, an unroller apparatus 100 generally includes a frame 102 that includes a base 104, and left and right arms 106, 108 that extend upwards from near the back 110 of the base and then extend over the base. The base 104 preferably includes a plate-like base that is sized and configured to receive multiple spools of wire placed side by side one another. As discussed in greater detail below, wire may placed onto the base 104 either in front of or between the arms 106, 108 and may then be rolled and unrolled from a front 112 of the base 104.

The arms 106, 108 may be permanently fixed to the base 104, such as by welding, or may be removably connected by removable connectors, such as bolts, to allow the arms to be removed and the apparatus to be collapsed and stored. In certain embodiments, each arm 106, 108 is constructed from a number of interconnected sections. For example, the left arm 106 may include a first arm section 106A that is fixedly mounted to the base 104 and a second arm section 106B that is rotatably mounted at the top of the first arm section. Similarly, the right arm 108 may include a first arm section 108A that is fixedly mounted to the base 104 and a second arm section 108B that is rotatably mounted at the top of the first arm section. In other embodiments, each of the arms 106, 108 is formed as a single, non-movable unit.

Figure 5:
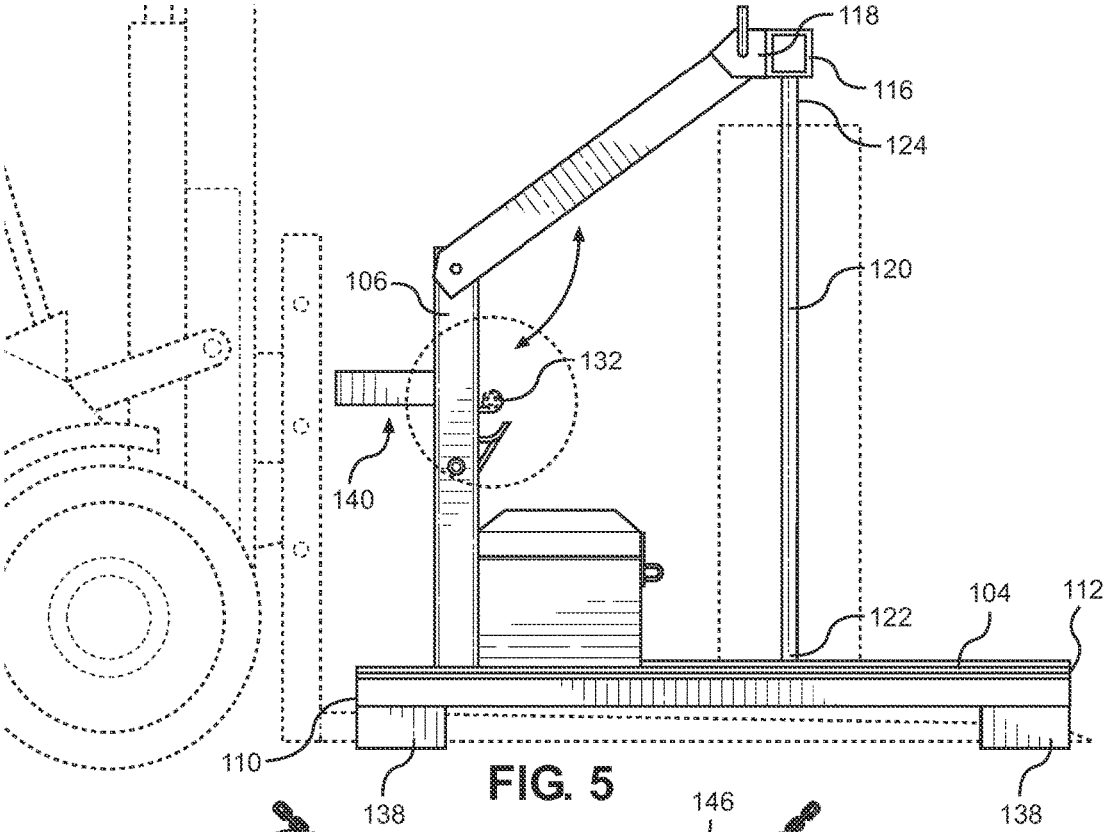
FIG. 5 is a side elevation view of a wire unroller apparatus according to embodiments of the present invention mounted to forks of a forklift mounted to a tractor.
Figure 6:
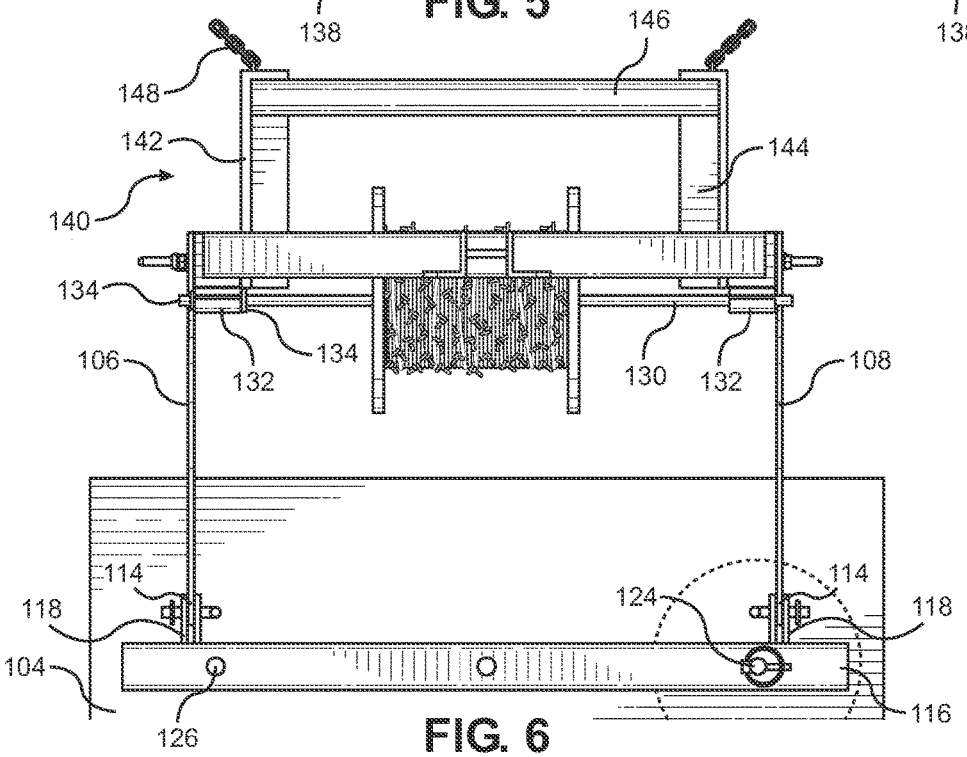
FIG. 6 is a top-down view of a wire unroller apparatus according to an embodiment of the present invention.

As shown in FIGS. 5 and 6, each of the arms 106, 108 includes an attachment end 114 that is configured to attach to a crossbar 116. The crossbar 116 includes receivers 118 that receive the ends 114 of each of the arms 106, 108 and that position the arms in a uniform orientation with respect to one another. Preferably, the crossbar 116 is movable even after being connected to the arms so that is may be repositioned as needed. For example, in certain embodiments, the receiver 118 includes a pin that is inserted through openings in each of the receivers and through openings in the arms 106 108 to rotatably mate the two together. This would enable the crossbar 116 to be able to rotate with respect to each of the arms 106 108 so that the crossbar may be oriented as necessary.

Figure 2:
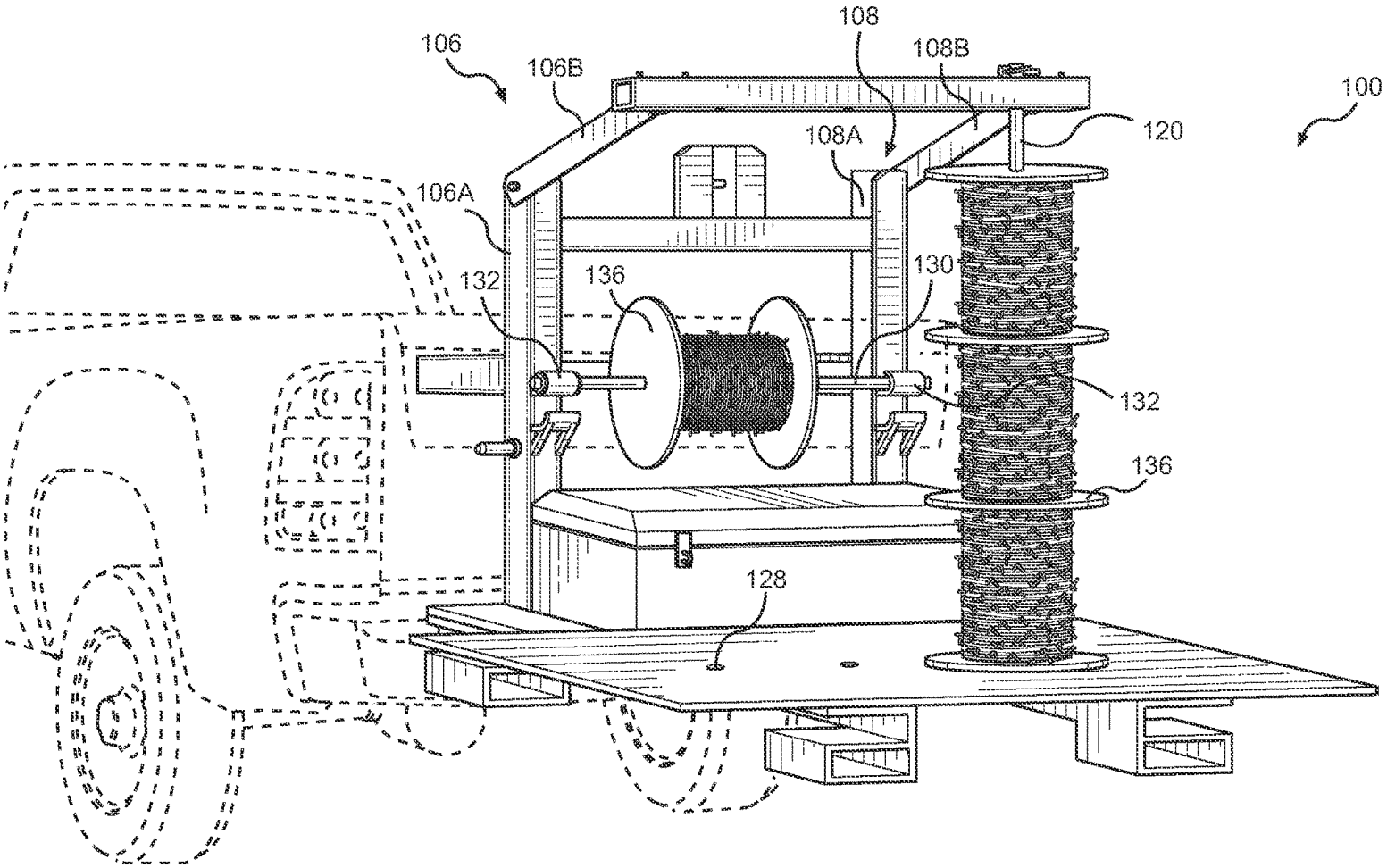
FIG. 2 is a perspective view of the wire unroller shown in FIG. 1 where two vertical spools have been removed to show a horizontal spool loaded with wire.
Figure 3:
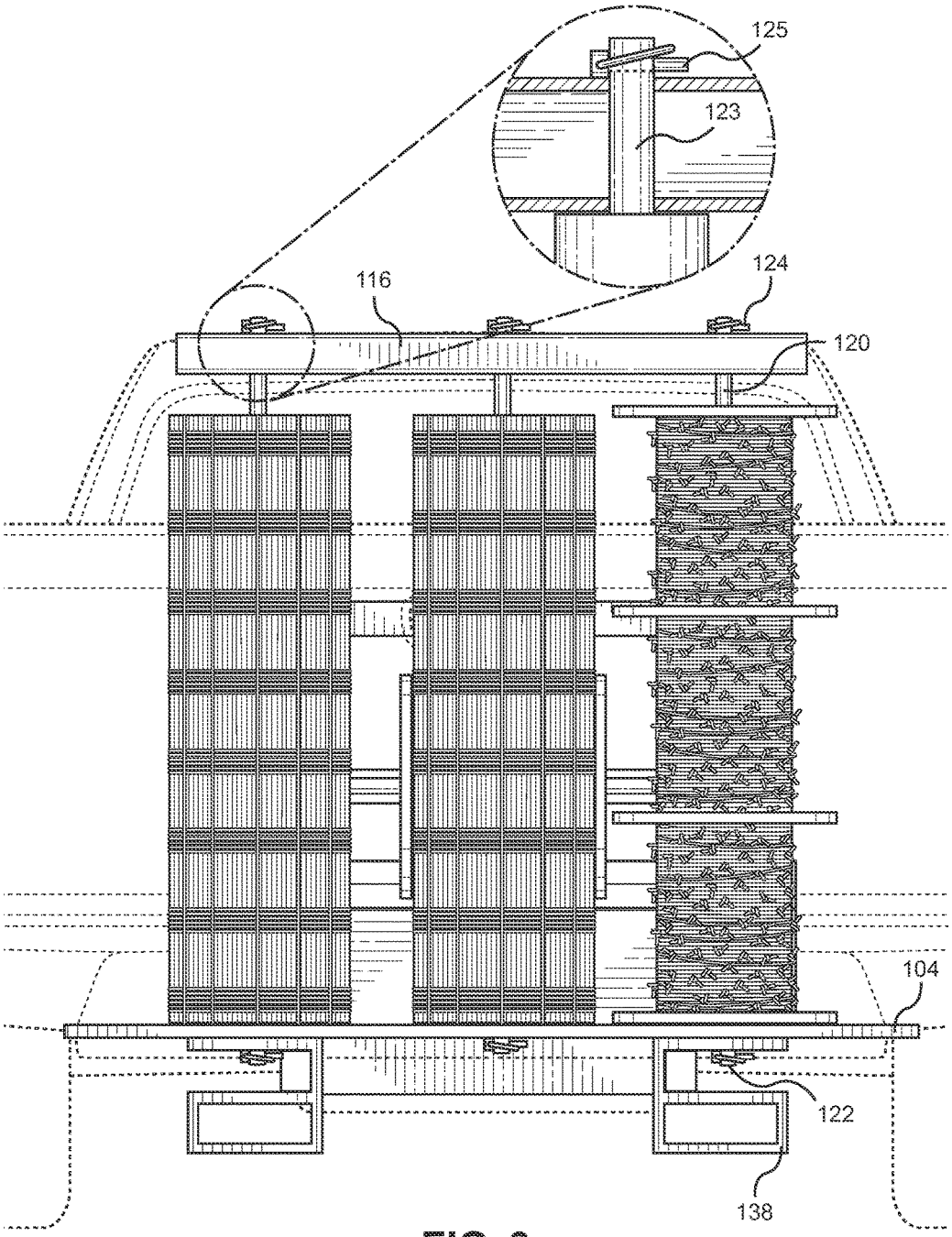
FIG. 3 is a front elevation view of the wire unroller shown in FIG. 1.
Figure 4:
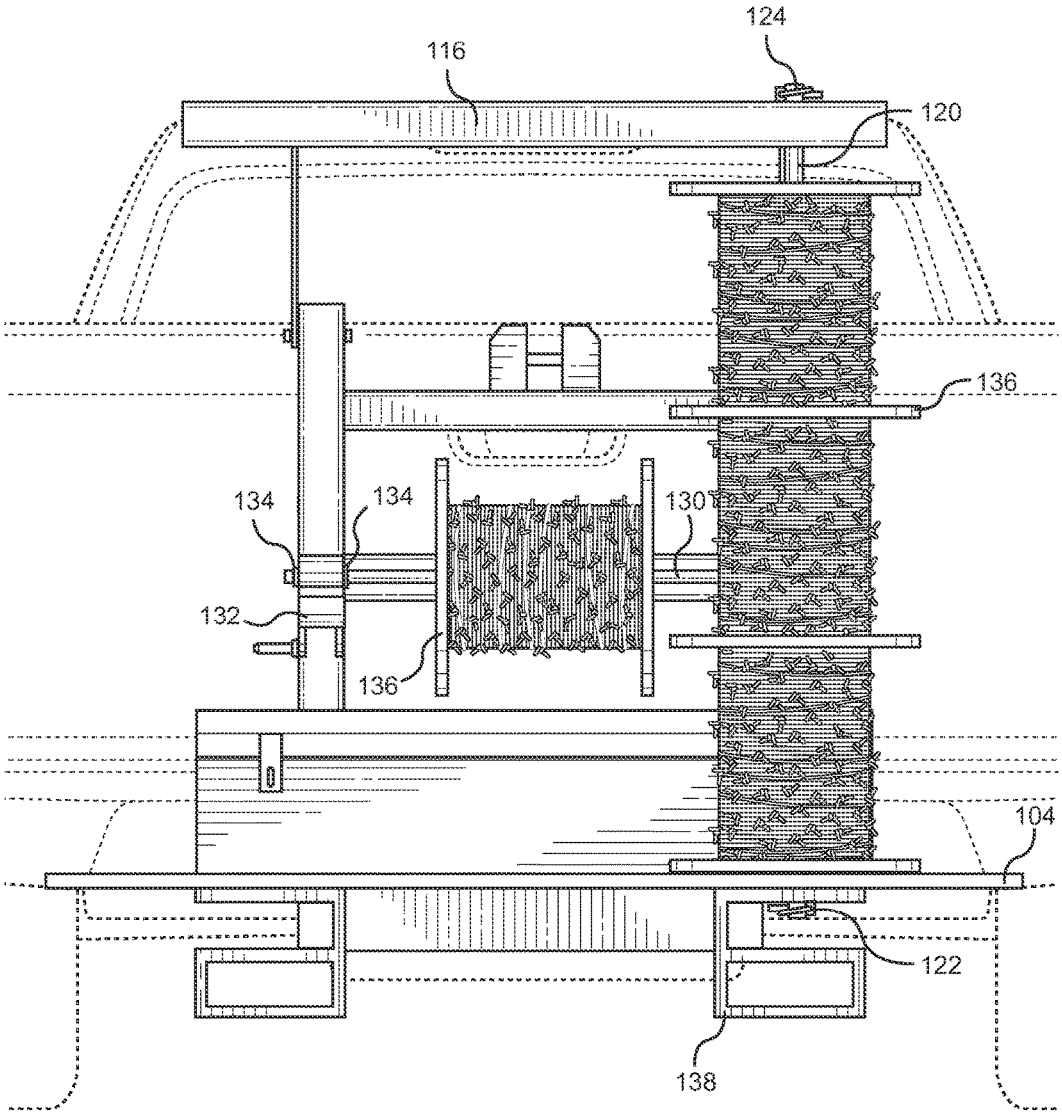
FIG. 4 is a front elevation view of the wire unroller shown in FIG. 2.

With reference to FIGS. 3-5, one or more elongate vertical spindles 120 are inserted through spools of wire and connected between the crossbar 116 and the base 104. One method for accomplishing this is to first place the spools of wire into position on the base and then the vertical spindles 120 are inserted through central openings in the spools of wire. Ends of the spindles 120 are then removably mounted to the base 104 and the crossbar 116. Each spindle 120 includes a first end 122 that may be removably connected to the base surface 104 and a second end 124 that may be removably connected to the cross bar 116. As shown in FIG. 6, the crossbar 116 may include a number of connections points 126 for connecting the second end 124 of the one or more spindles 120 to the crossbar at different locations. As shown in FIG. 2, corresponding connection points 128 are provided on the base 104 for connecting to the first end 122 of the spindles 120.

In this particular embodiment, connection points 126, 128 are openings that are located in the base 104 and in the crossbar 116. As shown best in FIG. 3, the ends of the spindles 120 include extension sections 123 that are inserted into these openings and are pinned into place with removable pins 125. To facilitate inserting the spindle 120 into the base 104 and crossbar 115, the extension sections 123 of the ends 122, 124 preferably have a diameter that is less than the diameter of a middle section of the spindle located between the ends and also slightly less than the diameter of openings 126, 128 in the crossbar 116 and base 104. The center of the spindle 120 has a diameter that is larger than the openings 126, 128 so that the spindle is prevented from falling through the opening in the base 104. Each of the ends 122, 124 may further include openings that are designed to receive the pin 125. The openings in the ends 122, 124 are located so that, after the extension sections 123 at both ends 122, 124 of the spindle 120 are inserted into the base 104 and crossbar 116, they extend above the top surface of the crossbar and below the bottom of the base. Once the extension sections 123 of the ends 122, 124 of the spindle 120 have been inserted through the openings in the crossbar 116 and the base 104, pins 125 may be inserted through each of the openings, which prevents the spindle from being pulled out of the crossbar and base.

The connection points 128 in the base are located so that the rolls of wire placed onto the spindles 120 do not interfere or come into contact with other rolls of wire or other portions of the apparatus 100. In this particular embodiment, as shown in FIG. 2, a single set of openings 128 is placed generally in the center of the base 104, which should be suitable for the majority of wire spools. However, the base 104 may include multiple sets of openings from the back 110 to the front 112 of the base that are designed to allow spools of varying heights and diameters to be placed closer to the front or closer to the back of the base, as needed. For example, a particularly wide roll of wire may not fit onto the device if the spindle 120 is located at the center opening. However, the same roll of wire might fit onto the device when the spindle is positioned in an opening that is located near the front edge 112 of the base 114.

The diameter and length of the spindles 120 themselves may vary in order to accommodate different sized spools of wire. For example, a spool of wire having a narrow central opening might require the use of a narrow spindle 120. Conversely, it may sometimes be preferable to have a spindle 120 with a larger diameter to fit a spool of wire having a larger opening. To prevent narrow spindles 120 from falling through the openings 128 in the base 104, one end of the spindle may include a contact member, such as a washer, that has a diameter that is greater than the opening in the base 104 and that prevents the narrow spindle from falling into the opening in the base. This contact member is fixedly mounted to the spindle 120 at a distance that permits the spindle to be inserted to the desired distance into the opening so that the pin may be inserted into the opening in the spindle.

Preferably, the apparatus 100 is configured to receive one or more spindles 120, with each spindle capable of holding one or more spools of wire. In FIG. 1, three vertical spindles 120 are shown, including two spindles having spools of field fence or woven wire and a third spindle having multiple spools of barbed wire stacked on top of one another.

With reference to FIGS. 2 and 4, In addition to the spindles 120 described above, which are oriented vertically and which are mounted between the crossbar 116 and base 104, the apparatus 100 may further include a second spindle 130 that is oriented horizontally and that may be removably secured between the vertical arms 106, 108. The horizontal spindle 130 may be mounted to the arms 106, 108 by placing ends thereof into cradles 132 that are fixedly mounted to each of the arms. The cradles 132 are hook shaped and have upward facing openings that receive the spindle 130. Once a spindle 130 has been placed into the cradle 132, the weight of the spindle prevents it from lifting out of the cradle.

To prevent the spindle 130 from moving from side to side, the spindle 130 may include a pair of centering members 134 that are fixed on one end of the spindle. When the spindle 130 is placed into the cradles 132, the centering members 134 are located on left and right sides of one of the cradles, which limits side-to-side movement of the spindle. Preferably, only one end of the spindle 130 has centering members 134 and the opposite end remains rod-like (i.e., without centering members) so that spools of wire may slide onto the spindle.

In certain embodiments, multiple pairs of cradles 132 are mounted to the arms 106, 108. This provides for alternative locations for placing the spindle 130. The additional cradles 132 may also be used as utility hooks for hanging equipment, bags, tools, etc.

Preferably, when multiple spools of wire are placed onto either the horizontal spindle 120 or the vertical spindle 130, a spool separator 136 is placed between adjacent spools. Additionally, spool separators 136 are preferably placed between the outermost spools and the frame 102. For example, as shown in FIG. 2, a spool separator 136 is between two adjacent spools of barbed wire on the vertical spindle 120 and also between the spool and the left or right arms 106, 108 of the apparatus on the horizontal spindle 130. Use of spool separators 136 in this manner assists in preventing the rotating spools from contacting and/or binding with other adjacent spools or with the wire unroller apparatus 100 itself. Additionally, providing spool separators assists in preventing accidental contact between objects or bystanders and the spool of wire as the spools are rotated.

Preferably, the spool separators 136 are disc- or doughnut-shaped, having a central opening that allows the separator to be inserted over the spindles. The spool separators 136 may be provided in a range of sizes having differing diameters. Preferably, the spool separators 136 have an outer diameter that is at least equal to or greater than the outer diameter of each spool of wire on the spindle such that the wire never extends beyond the outer edge of the spool separator. This size selection step is important to assist in preventing accidental contact with the wire spool as it rotates about the spindle. The spool separator 136 may be constructed from any generally rigid material that is able to withstand wear caused by contact with the wire spools and to maintain a suitable useful life. An example of a suitable material is steel.

The apparatus may be mounted to or suspended from a vehicle, which allows for greater mobility and also allows a greater number of wire spools to be unrolled more easily than by other traditional means. Preferably, a portion of the base 102 may be mounted to a receiver hitch, forklift or 3-prong hitch and then mounted to a vehicle.

With reference to FIG. 5, to enable the apparatus to be mounted to a forklift, receivers 138 may be mounted to the bottom of the base 104. Receivers 138 are preferably mounted at least at the back 110 and front 112 of the base 104. The forks of the forklift are inserted into the receivers 138 and then the apparatus 100 may be lifted off of the ground.

The apparatus 100 may also include a guard 140 which limits the movement of the forklift and prevents the forklift from contacting the spools of wire on the horizontal spindle 130. This ensures that the spools of wire remain free to turn and are not damaged by the forklift when it is mounted to the apparatus 100. In this particular embodiment, the U-shaped guard includes a horizontal left arm 142 extending backwards from the vertical left arm 106, a horizontal right arm 144 extending backwards from the vertical right arm 108, and a crossbar 146 connected between ends of the horizontal left and right arms.

In certain embodiments, as shown in FIG. 6, connection points 148 for connecting a retention strap to the apparatus 100 are mounted to a portion of the base 102. For example, ends of a tie down strap or a chain may be hooked to the connection points and then secured around a portion of the forklift in order to prevent the apparatus 100 from falling off of the forks. In the embodiment shown, connection points 148 are affixed to the left and right arm 142, 144 of the guard 140. However, connection points 148 may be mounted to other sections of the apparatus 100, such as to the base 104.

Figure 7:
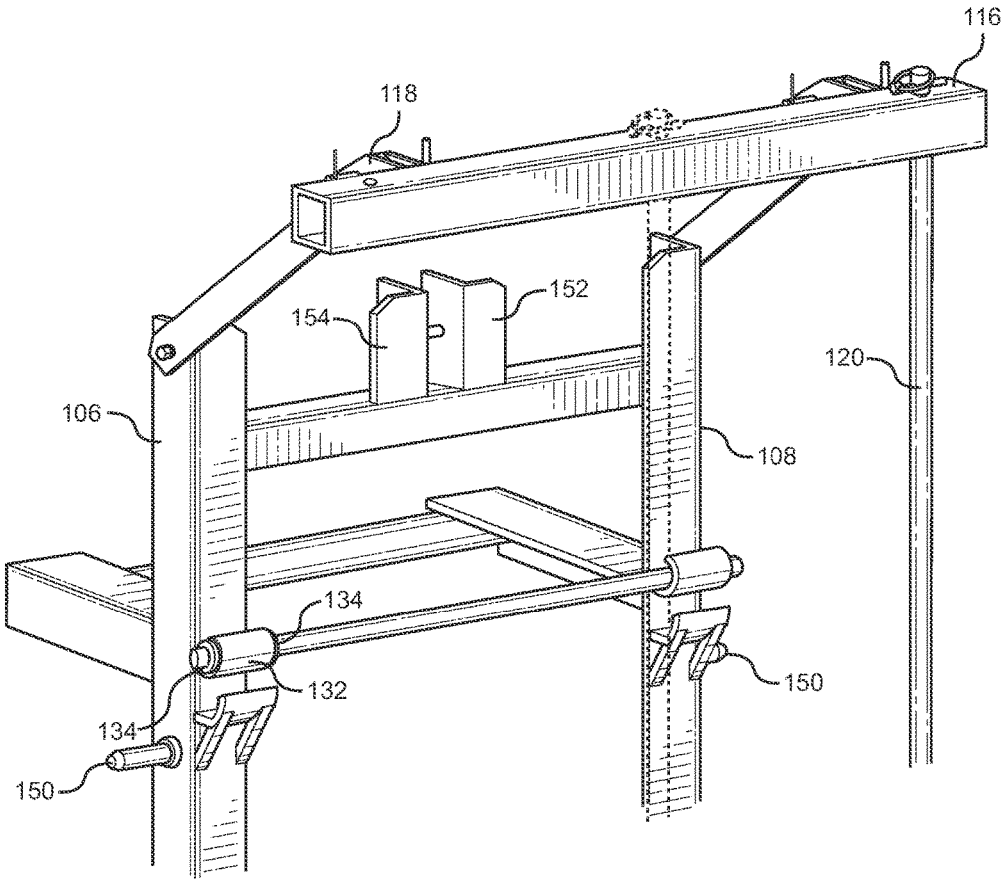
FIG. 7 is a perspective view of a wire unroller apparatus according to embodiments of the present invention and providing a close view of the vertical spools, arms and top bar.
Figure 8:
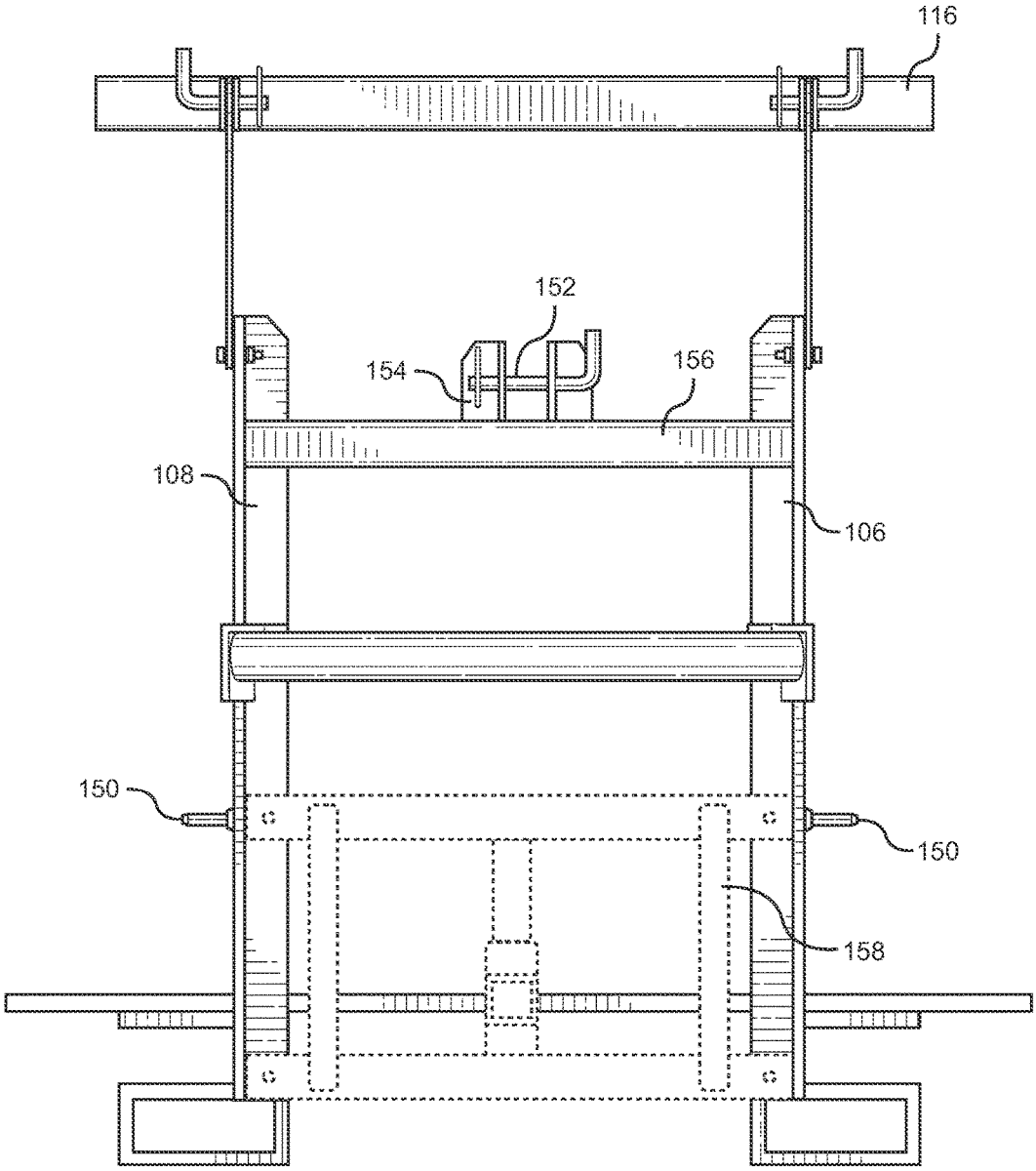
FIG. 8 is a rear view of a wire unroller apparatus according to embodiments of the present invention equipped with an optional truck hitch accessory.

The apparatus 100 may also be mounted to a vehicle using a 3-point hitch device. With reference to FIGS. 7 and 8, the apparatus 100 may include lower linkage pins 150 that are mounted to and extend outwards from the left and right vertical arms 106, 108, and that are configured to connect to lower hitch lifting arms. Additionally, the apparatus includes an upper linkage pin 152 is configured to connect to the upper center arm or top link of the three-point hitch. In this particular embodiment, the upper pin 152 is mounted between two vertical posts 154, which are mounted to a middle support 156 that is fixed between the vertical left and right arms 106, 108.

Figure 9A:
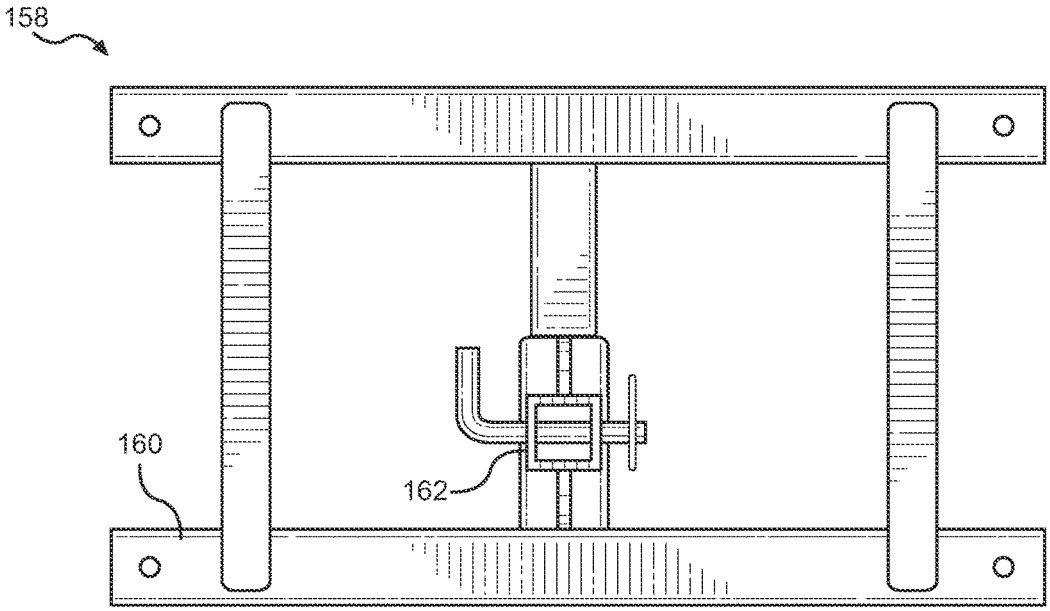
FIG. 9A is a front elevation view of the truck hitch accessory shown in FIG. 8.
Figure 9B:
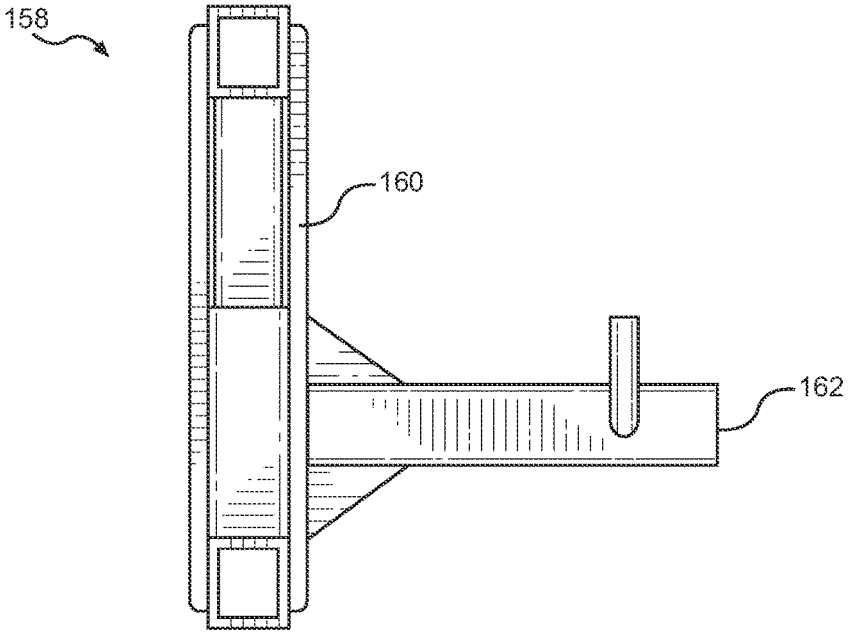
FIG. 9B is a side elevation view of the truck hitch accessory shown in FIG. 8.

The apparatus 100 may also be mounted to a vehicle's receiver hitch. With reference to FIGS. 8, 9A and 9B, a removable adaptor 158 including a frame 160 that may be removably mounted, such as by threaded connectors or bolts, to a portion of one side of the vertical left and right arms 106, 108, and also a receiver hitch mount 162 that is inserted into a receiver hitch of a vehicle.

In certain preferred embodiments, a toolbox 164 may be removably mounted to the other side of the left and right vertical arms 106, 108.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. A wire unroller apparatus comprising:

a base configured to be removably mounted to a vehicle, the base having:

a base surface;

left and right arms extending away from the base surface and terminating at ends;

a cross bar removably connected to the ends of the left and right arms; and a first spindle configured to receive one or more spools of wire disposed in a first direction and having a first end removably connected to the base surface and a second end removably connected to the cross bar; and a second spindle disposed in a second direction and configured to receive one or more spools of wire, the second spindle removably connected to the left and right arms and configured such that the one or more spools of wire are disposed between the left and right arms; and cradles disposed on the left and right arms, wherein the second spindle is configured to be placed into the cradles;

wherein the one or more spools of wire on the first spindle and the second spindle may be unrolled at the same time.

2. The wire unroller apparatus of claim 1 further comprising a guard having ends connected to the left and right arms proximate the second spindle and extending away from the left and right arms, the guard configured to contact a portion of the vehicle to prevent the vehicle from contacting the one or more spools of wire located on the second spindle.

3. The wire unroller of claim 1 wherein the second spindle further comprises a pair of centering members configured for placement on either side of one of the cradles to prevent side-to-side movement of the second spindle when placed into the cradles.

4. The wire unroller of claim 1, wherein each of the left and right arms further comprise a first arm section extending away from the base surface and a second arm section rotatably mounted to the first arm section and terminating at an end.

5. The wire unroller apparatus of claim 1 further comprising two or more forklift receivers mounted to a bottom surface of the base, the two or more forklift receivers configured to receive forks of a forklift.

6. The wire unroller apparatus of claim 1 further comprising one or more strap connection points disposed on the unroller apparatus and configured to receive one or more straps for removably securing a portion of the unroller apparatus to a portion of the vehicle.

7. The wire unroller apparatus of claim 1 further comprising at least one spool separator configured for placement onto at least one of the first or second spindles adjacent the one or more spools of wire.

8. The wire unroller apparatus of claim 1 further comprising a receiver hitch mount having a base mount configured to removably mount to the base and a vehicle mount configured to be mounted to a receiver hitch of a vehicle.

9. The wire unroller apparatus of claim 1 further comprising a plurality of linkage pins configured for attachment to a 3-point hitch.

10. The wire unroller apparatus of claim 1 wherein:

the first end of the first spindle includes an elongate extension portion configured for insertion through an opening disposed in the base surface and having an opening configured to receive a pin to removably fix the extension portion in the opening in the base surface; and the second end of the first spindle includes an elongate extension portion configured for insertion through an opening disposed in the crossbar and having an opening configured to receive a pin to removably fix the extension portion in the opening in the crossbar.

11. A wire unroller apparatus comprising:

a base configured to be removably mounted to a vehicle, the base having:

a base surface;

left and right arms extending away from the base surface and terminating at ends, wherein cradles are disposed on the left and right arms for providing alternate locations for spindles;

a cross bar removably connected to the ends of the left and right arms; and a plurality of first spindles, each configured to receive one or more spools of wire and being disposed in a first direction and having a first end removably connected to the base surface and a second end removably connected to the cross bar;

wherein the one or more spools of wire on the plurality of first spindles may be unrolled at the same time.

12. The wire unroller of claim 11, wherein each of the left and right arms further comprise a first arm section extending away from the base surface and a second arm section rotatably mounted to the first arm section and terminating at an end.

13. The wire unroller apparatus of claim 11 further comprising two or more forklift receivers mounted to a bottom surface of the base, the two or more forklift receivers configured to receive forks of a forklift.

14. The wire unroller apparatus of claim 11 further comprising one or more strap connection points disposed on the unroller apparatus and configured to receive one or more straps for removably securing a portion of the unroller apparatus to a portion of the vehicle.

15. The wire unroller apparatus of claim 11 further comprising at least one spool separator configured for placement onto the first spindles adjacent the one or more spools.

16. The wire unroller apparatus of claim 11 further comprising a receiver hitch mount having a base mount configured to removably mount to the base and a vehicle mount configured to be mounted to a receiver hitch of a vehicle.

17. The wire unroller apparatus of claim 11 further comprising a plurality of linkage pins configured for attachment to a 3-point hitch.

18. A wire unroller apparatus comprising:

one or more spools of wire;

a base configured to be removably mounted to a vehicle, the base having:

a base surface;

left and right arms extending away from the base surface and terminating at ends;

a cross bar removably connected to the ends of the left and right arms; and a first spindle configured to receive at least one of the one or more spools of wire disposed in a first direction and having a first end removably connected to the base surface and a second end removably connected to the cross bar;

a second spindle disposed in a second direction and configured to receive one or more spools of wire, the second spindle removably connected to the left and right arms and configured such that the one or more spools of wire are disposed between the left and right arms; and cradles disposed on the left and right arms, wherein the second spindle is configured to be placed into the cradles;

wherein the one or more spools of wire on the first spindle and the second spindle may be unrolled at the same time.

19. The wire unroller apparatus of claim 18 further comprising two or more first spindles removably connected vertically between the base surface and to the cross bar.

* * * * *